US007296633B2

(12) United States Patent
Bode et al.

(10) Patent No.: US 7,296,633 B2
(45) Date of Patent: Nov. 20, 2007

(54) FLOW CONTROL APPARATUS FOR USE IN A WELLBORE

(75) Inventors: Jeffrey Bode, The Woodlands, TX (US); Craig Fishbeck, Conroe, TX (US); Jeffrey John Lembcke, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 270 days.

(21) Appl. No.: 11/013,863

(22) Filed: Dec. 16, 2004

(65) Prior Publication Data

US 2006/0131033 A1 Jun. 22, 2006

(51) Int. Cl.
*E21B 43/12* (2006.01)

(52) U.S. Cl. ..... 166/386; 166/334.1; 166/369

(58) Field of Classification Search ..... 166/369, 166/386, 320, 321, 332.1, 334.1
See application file for complete search history.

(56) References Cited

U.S. PATENT DOCUMENTS

| | | | | |
|---|---|---|---|---|
| 4,109,725 | A * | 8/1978 | Williamson et al. | 166/373 |
| 4,134,454 | A * | 1/1979 | Taylor | 166/320 |
| 4,576,235 | A * | 3/1986 | Slaughter et al. | 166/374 |
| 4,611,974 | A * | 9/1986 | Holland | 417/388 |
| 5,676,208 | A * | 10/1997 | Finley | 166/278 |
| 6,059,038 | A * | 5/2000 | Vick, Jr. | 166/319 |
| 6,371,210 | B1 | 4/2002 | Bode et al. | |
| 6,422,317 | B1 * | 7/2002 | Williamson, Jr. | 166/374 |
| 6,644,412 | B2 | 11/2003 | Bode et al. | |
| 6,883,613 | B2 * | 4/2005 | Bode et al. | 166/373 |
| 7,059,401 | B2 * | 6/2006 | Bode et al. | 166/51 |
| 2004/0154806 | A1 * | 8/2004 | Bode et al. | 166/373 |
| 2005/0189106 | A1 * | 9/2005 | Bode et al. | 166/227 |
| 2006/0070744 | A1 * | 4/2006 | Smith | 166/386 |
| 2006/0131033 | A1 * | 6/2006 | Bode et al. | 166/386 |

OTHER PUBLICATIONS

EP Search Report, Application No. 05112026.9, dated Mar. 8, 2006.

* cited by examiner

*Primary Examiner*—David Bagnell
*Assistant Examiner*—David Andrews
(74) *Attorney, Agent, or Firm*—Patterson & Sheridan, LLP

(57) ABSTRACT

Methods and apparatus for use in a welibore to meter and choke certain components from being produced, based upon their density relative to the density of oil are described herein. The device includes an inner tubular body portion having apertures in the wall thereof for passing oil, an outer tubular body and at least one metering orifice therebetween to meter production. Disposed around the inner body is an axially movable member to selectively cover and expose the apertures of the inner body, thereby permitting fluid to flow therethrough.

6 Claims, 3 Drawing Sheets

200
205
209
202
211
212
203
GAS
OIL
204
206
208
210
WATER

FLOW CONTROL APPARATUS FOR USE IN A WELLBORE

BACKGROUND OF THE INVENTION

1. Field of the Invention

The invention relates to the control of fluid flow into a wellbore. More particularly, the invention relates to a flow control apparatus that is self adjusting to meter production and choke the flow of gas into the wellbore.

2. Description of the Related Art

In hydrocarbon wells, horizontal wellbores are formed at a predetermined depth to more completely and effectively reach formations bearing oil or other hydrocarbons in the earth. Typically, a vertical wellbore is formed from the surface of a well and thereafter, using some means of directional drilling like a diverter, the wellbore is extended along a horizontal path. Because the hydrocarbon bearing formations can be hundreds of feet across, these horizontal wellbores are sometimes equipped with long sections of screened tubing which consists of tubing having apertures therethough and covered with screened walls, leaving the interior of the tubing open to the inflow of filtered oil.

Horizontal wellbores are often formed to intersect narrow oil bearing formations that might have water and gas bearing formations nearby. FIG. 1 illustrates two such nearby formations, one of water and one of gas. Even with exact drilling techniques, the migration of gas and water towards the oil formation and the wellbore is inevitable due to pressure drops caused by the collection and travel of fluid in the wellbore. Typically, operators do not want to collect gas or water along with oil from the same horizontal wellbore. The gas and water must be separated at the surface and once the flow of gas begins it typically increases to a point where further production of oil is not cost effective. Devices have been developed that self adjust to control the flow of fluid into a horizontal wellbore. One such device is shown in U.S. Pat. No. 6,371,210 owned by the same assignee as the present invention and that patent is incorporated by reference in its entirety herein. The '210 patent teaches a self-adjusting device that chokes the flow of fluid into a horizontal wellbore as the flow of fluid increases relative to a preset value determined by a spring member. Multiple devices can be placed along the length of a wellbore to help balance the inflow of production throughout the length of the wellbore. The device includes a piston that is depressed by a force generated by fluid flow. The device is especially useful when several are used in series along the length of a horizontal wellbore. However, the devices are not designed to meter production while choking unwanted production components due to its lack of a constantly sized orifice though which to meter the flow of production and determine the relative amounts of gas or water.

There is a need therefore, for a self-adjusting flow control apparatus for downhole use in a wellbore that operates to limit the inflow of gas or water into the wellbore when that component in a production stream reaches a predetermined percentage relative to the oil. There is a further need, for a flow control apparatus for use in a wellbore that is self-regulating and self-adjusts for changes in the amount of fluid and gas in a production stream. There is yet a further need for a flow control apparatus that meters the flow of production into a horizontal wellbore.

SUMMARY OF THE INVENTION

The present invention provides an apparatus for use in a hydrocarbon producing wellbore to prevent the introduction into the wellbore of gas and/or water when the gas or water is of a given percentage relative to the overall fluid content of the production. In one aspect of the invention, a perforated inner tube is surrounded by at least one axially movable member that moves in relation to a pressure differential between sides of a piston having at least one sized orifice through which the production flows to enter the wellbore. The movable member selectively exposes and covers the perforations of the inner tube to pass or choke production. In another embodiment, a method is disclosed to choke the flow of production into a wellbore when a predetermined component of the production is made up of gas or water.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, For the invention may admit to other equally effective embodiments.

DETAILED DESCRIPTION

Figure 1:
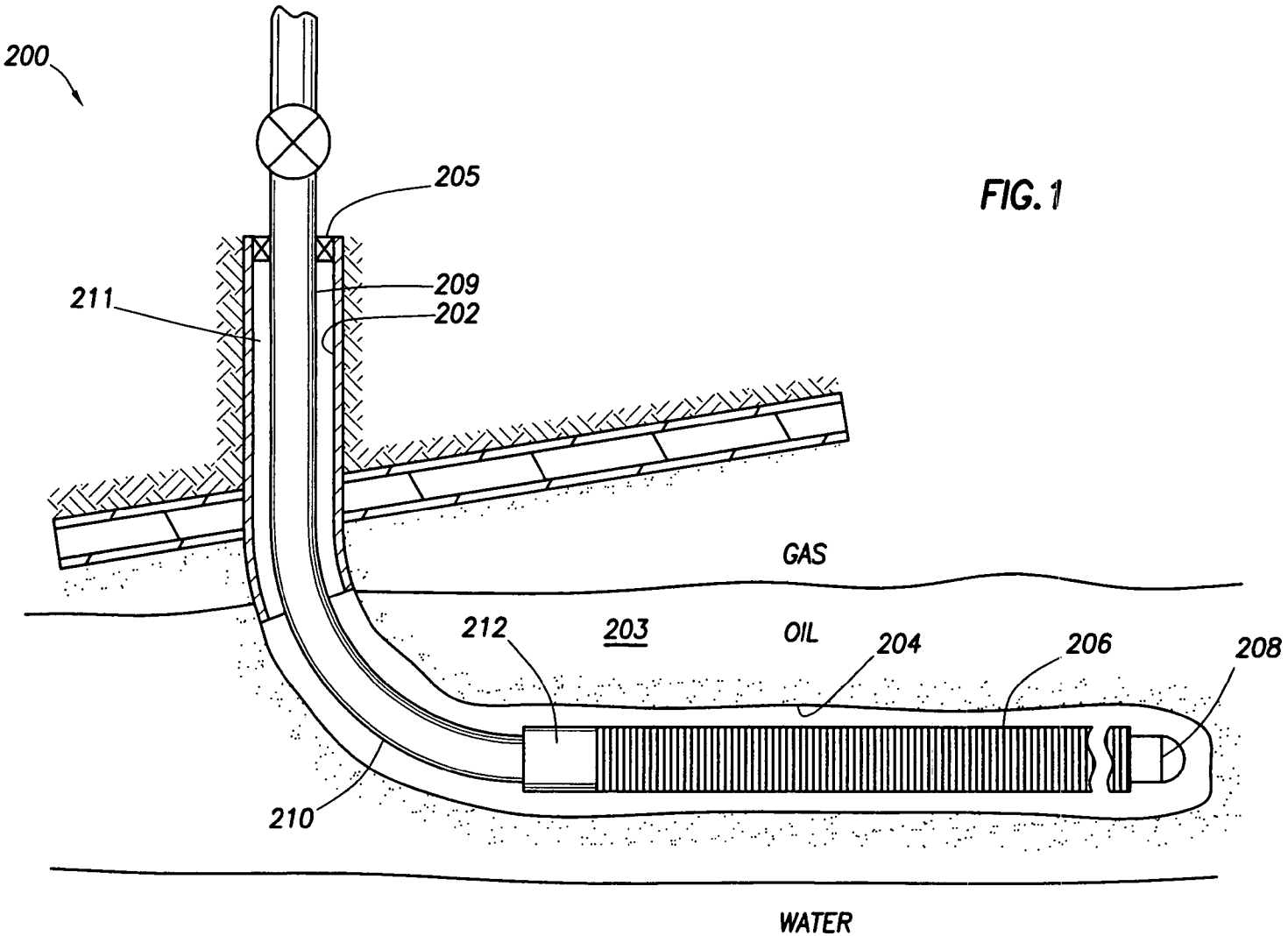
FIG. 1 depicts a partial cross-sectional view of a vertical and horizontal hydrocarbon wellbore having a sand screen in the horizontal wellbore.

The present invention is intended to effectively monitor and self adjust the flow of production into a wellbore depending upon the components in the production. To facilitate the description of the invention, the device will typically be described as it would function in the presence of gas and oil in a production stream. However, it will be understood that the invention operates primarily due to differences in densities between oil and another component of production in a wellbore and could operate in the presence of oil and water or any other component having a density distinct from oil. FIG. 1 depicts a cross-sectional view of a well 200 having a flow control apparatus 212 of the present invention located therein. Specifically, an apparatus 212 for controlling the flow of oil or some other hydrocarbon from an underground reservoir 203 through the well 200 is depicted. The well 200 includes a cased, vertical wellbore 202 and an uncased, horizontal wellbore 204. Production tubing 209 for transporting oil to the surface of the well is disposed within the vertical wellbore 202 and extends from the surface of the well 200 through a packing member 205 that seals an annular area 211 around the tubing and isolates the wellbore therebelow. The horizontal wellbore 204 includes a section of screened tubing 206. The screened tubing 206 continues along the horizontal wellbore 204 to a toe 208 thereof. The apparatus 212 is attached to the screened tubing 206 near the heel 210 of the horizontal wellbore 204.

Figure 2:
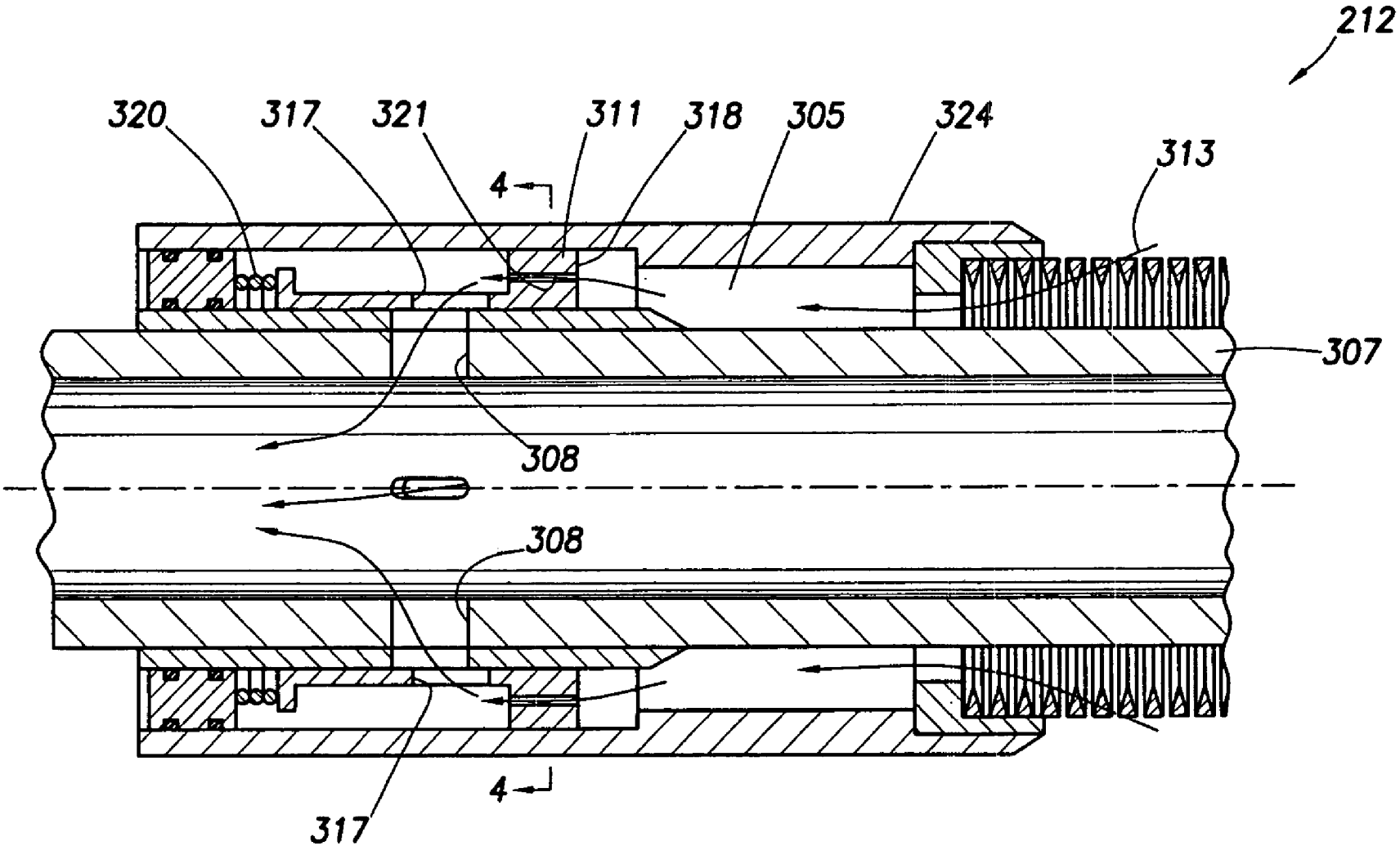
FIG. 2 is a partial cross-sectional view of the apparatus of the subject invention in an open position.

FIG. 2 is a more detailed view of the apparatus 212 of the present invention. In the embodiment of FIG. 2, the flow control apparatus 212 is a two-position apparatus with a first position preventing the flow of production and a second position permitting the inflow of production into the production tubing 209. The apparatus 212 is shown in the second, open position. The apparatus 212 is additionally designed to assume any number of positions between the first and second positions, thereby providing an infinitely adjustable restriction to the inflow of production into the interior of the device.

The apparatus 212 includes an inner tubular body 307 and an outer tubular body 324 disposed therearound. Disposed in an annular area 305 between the inner 307 and outer 324 bodies is an axially slidable sleeve member 311 which is biased in a first position relative to the inner body 307 by a spring 320 or other biasing member. In the position shown in FIG. 2, apertures 317 formed in the sleeve 311 are substantially aligned with mating apertures 308 formed in the inner body 307 to permit the passage of production fluid from the wellbore into the inner tube 307. The production fluid flow into the apparatus is illustrated by arrows 313. A piston surface 318 is formed on the sleeve 311 and is constructed and arranged to cause the sleeve 311 to become deflected and to move axially in relation to the inner body when acted upon by production fluid with sufficient momentum, mass and density to overcome the resistive force of the spring 320 and a pressure differential across the sleeve 311. Specifically, the spring 320 is selected whereby a mass flow rate created by a pressure differential will result in a fluid momentum adequate to deflect the sleeve 311, thereby shifting the apparatus 212 from the first fully closed position to the second, open position as it is shown in FIG. 2.

Formed in the piston surface 318 are at least one orifice 321 that meters the flow of production into the apparatus 212 and defines the pressure differential across the sleeve 311 based on flow rate and density of the fluids passing through the orifice 321. In the design shown in FIG. 2, the only fluid path to the inner tube 307 is through the orifice 321 which is sized to permit flow but also to meter the production fluid as it travels through the sleeve 311. In a preferred embodiment, when a certain percentage of the production fluid is made up of oil, its density will be adequate to cause a sufficient pressure differential as it flows through the orifice 321 to depress the sleeve 311 while an adequate amount flows through the orifice 321 sized to permit the flow of oil. If however, a substantial amount of gas is a component of the production fluid (or any other substance with a lower density than oil), the gas will not have adequate density to cause a sufficient pressure differential as it flows through the orifice 321 to depress the sleeve 311, and any gas traveling through the orifice will be prevented from flowing into the wellbore. For some embodiments, the orifice 321 may not be formed in the sleeve 311 as long as the orifice 321 meters flow across the sleeve 311. For example, the orifice 321 can be an insert that is locked (threaded, brazed, etc.) in place.

Figure 3:
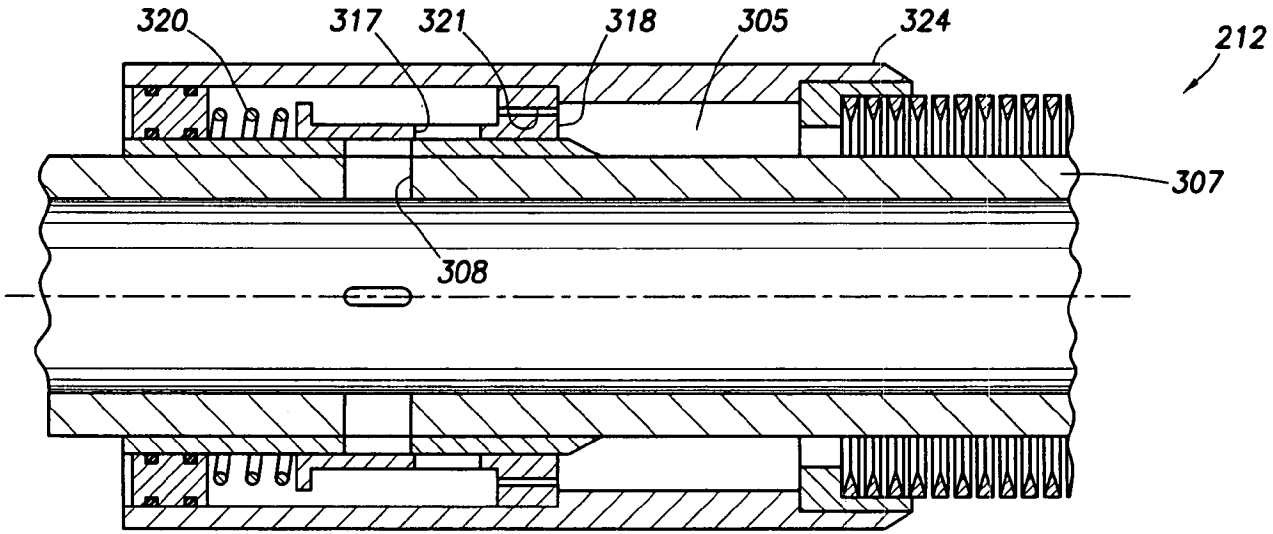
FIG. 3 is another cross-sectional view of the apparatus shown in a closed, choked position.

FIG. 3 is another section view of the apparatus 212 in the first or closed position. Accordingly, FIG. 3 illustrates the position of the sleeve 311 when there is not an adequate amount of force to depress the piston surface 318 due possibly to a lack of density in some component of the production.

Figure 4:
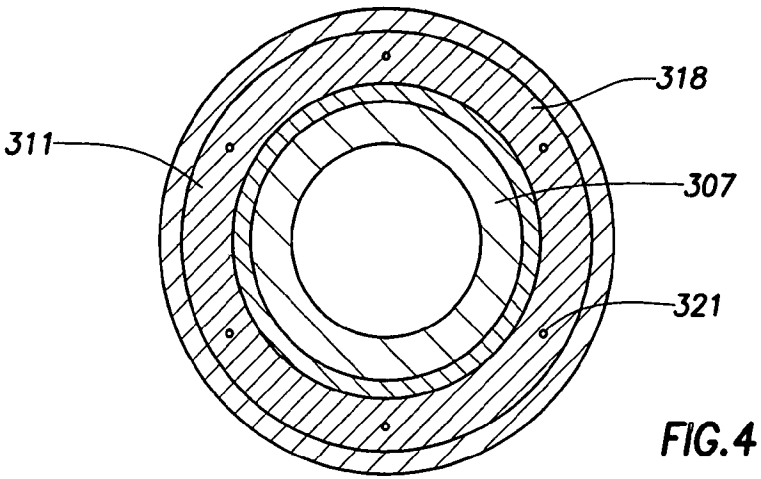
FIG. 4 is a cross-sectional view of a portion of the apparatus along a line 4-4 of FIG. 2.

FIG. 4 is a section view illustrating the radially spaced orifices 321 formed in the sleeve 311. In the embodiment shown, there are six orifices that serve to meter the inflow of production. The piston surface 318 which must be acted upon and depressed by pressure developed by the production fluid is the surface area of the face of the sleeve 311 less the area of the orifices 321. The orifices are sized to meter the flow of production permitting an adequate amount to flow through while the surface area of the piston and the spring member 320 against which it must act are designed to require that the production be made up of some predetermined, minimum amount of higher density oil than some other lower density material, like water or gas.

While the invention has been described as being fully self adjusting, it will be understood that in some instances the device might be remotely adjusted from the surface using a hydraulic control line to artificially influence movement of the sleeve or a solenoid that is battery powered and can be signaled from the surface of the well. At least one pressure sensor (not shown) can sense a pressure value and communicate the pressure value to the solenoid.

While the foregoing is directed to the preferred embodiment of the present invention, other and further embodiments of the invention may be devised without departing from the basic scope thereof, and the scope thereof is determined by the claims that follow.

The invention claimed is:

1. A method of controlling fluid flow into a hydrocarbon producing wellbore, comprising:

inserting a flow control apparatus into the wellbore adjacent a fluid bearing formation such that a fluid in the formation is in communication with an outer surface of the apparatus;

causing the fluid to act upon a piston surface formed on an axial movable sleeve in the apparatus;

metering inflow of the fluid across the sleeve through an orifice; through the piston surface; and causing the sleeve to shift in reaction to a fluid pressure applied to the piston surface by a predetermined density of components in the fluid, thereby misaligning one or more apertures formed in the sleeve with one or more apertures formed in an inner member of the apparatus.

2. The method of claim 1, whereby the components include at least oil and gas.

3. The method of claim 1, whereby the components include at least oil and water.

4. The method of claim 1, wherein the wellbore includes a horizontal wellbore.

5. A method of metering and choking gas into a horizontal wellbore, comprising:

disposing an apparatus in the wellbore, the apparatus having an outer slidable member and an inner member with at least one aperture disposed in a wall thereof, the outer member having a piston surface formed on a first side thereof;

causing a production fluid comprising at least oil and gas to act upon the piston surface while metering flow of the production fluid through the piston surface to a second side of the outer member with at least one metering orifice; and moving the slidable outer member in response to a fluid pressure applied to the piston surface by the production fluid when the production fluid has a first density at or above a predetermined density of oil, and permitting the outer member to remain unmoved in response to the production fluid having a second density below the predetermined density.

6. The method of claim 5, wherein the at least one metering orifice is formed in the piston surface.

* * * * *

UNITED STATES PATENT AND TRADEMARK OFFICE

CERTIFICATE OF CORRECTION

PATENT NO. : 7,296,633 B2
APPLICATION NO. : 11/013863
DATED : November 20, 2007
INVENTOR(S) : Bode et al.

It is certified that error appears in the above-identified patent and that said Letters Patent is hereby corrected as shown below:

In the Claims:

Column 4, Claim 1, Line 31, please delete “sleeve” and insert --piston surface--.

Signed and Sealed this

First Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,296,633 B2
APPLICATION NO. : 11/013863
DATED : November 20, 2007
INVENTOR(S) : Bode et al.

It is certified that error appears in the above-identified patent and that said Letters Patent is hereby corrected as shown below:

In the Claims:

Column 4, Claim 1, Line 32, please delete ";" after orifice.

Signed and Sealed this

Thirtieth Day of June, 2009

JOHN DOLL
*Acting Director of the United States Patent and Trademark Office*